US006586987B2

(12) United States Patent
Somerville et al.

(10) Patent No.: US 6,586,987 B2
(45) Date of Patent: Jul. 1, 2003

(54) CIRCUIT WITH SOURCE FOLLOWER OUTPUT STAGE AND ADAPTIVE CURRENT MIRROR BIAS

(75) Inventors: Thomas A Somerville, Tempe, AZ (US); Praveen V. Nadimpalli, Tempe, AZ (US)

(73) Assignees: Maxim Integrated Products, Inc., Sunnyvale, CA (US); Standard Microsystems Corporation, Hauppauge, NY (US)

( * ) Notice: Subject to any disclaimer, the term of this patent is extended or adjusted under 35 U.S.C. 154(b) by 0 days.

(21) Appl. No.: 09/881,596

(22) Filed: Jun. 14, 2001

(65) Prior Publication Data

US 2002/0190782 A1 Dec. 19, 2002

(51) Int. Cl.[7] ..... G05F 1/46
(52) U.S. Cl. ..... 327/542; 327/542; 323/316
(58) Field of Search ..... 327/540, 541, 327/542, 543; 323/313, 314, 315, 316

(56) References Cited

U.S. PATENT DOCUMENTS 4,506,208 A * 3/1985 Nagano ..... 327/535
5,592,123 A * 1/1997 Ulbrich ..... 330/288
5,973,959 A * 10/1999 Gerna et al. ..... 365/185.03
6,194,967 B1 * 2/2001 Johnson et al. ..... 330/288

* cited by examiner

*Primary Examiner*—Timothy P. Callahan
*Assistant Examiner*—Terry L. Englund
(74) *Attorney, Agent, or Firm*—Perkins Coie LLP

(57) ABSTRACT

A source follower output stage achieves low output impedance and high power supply rejection while operating at low output voltage and low supply voltage. This circuit has improved performance due to the source follower transistor, the sense transistor, and the output mirror, these items forming a common source difference amplifier. This common source difference amplifier adjusts the common voltage of the signal mirror to equalize the signal mirror input and output voltage. Thus, the common node of the mirror adapts to changing supply voltage, output load current and temperature so that the effect on source follower output voltage is minimized. Since the output node of the signal mirror is clamped to the source follower output instead of the common node of the mirror, the circuit operates at lower output and supply voltage than the prior art. For optimum performance, the current density ratio of the output mirror devices is equal to the current density ratio of the sense transistor to the source follower transistor.

26 Claims, 3 Drawing Sheets

CIRCUIT WITH SOURCE FOLLOWER OUTPUT STAGE AND ADAPTIVE CURRENT MIRROR BIAS

CROSS-REFERENCE TO RELATED APPLICATIONS

Not applicable.

STATEMENT REGARDING FEDERALLY SPONSORED RESEARCH

Not applicable.

1. Field of the Invention

The present invention relates generally to current mirror circuits, and more particularly to a low voltage source follower output stage that bootstraps the output impedance of the mirror driving it so that changes in input supply voltage and load current have substantially less effect on the output voltage.

2. Background of the Invention

"Bootstrapping" is a term of art in electronics, and is used to increase the output impedance of a current mirror, thereby increasing open loop gain and providing more closed loop accuracy as well as improved power supply rejection. Bootstrapping is commonly accomplished by driving a common circuit node so that the common circuit node voltage maintains a constant relationship to an output of the circuit. Bootstrapping also commonly requires additional supply current to bias the driver circuit.

Current mirrors are commonly used in operational amplifier circuits so that a single reference current may be used to generate additional currents referenced to each other throughout the circuit. A current mirror circuit may generally include a configuration such as a transistor, having its base and collector short-circuited, and connected at two points to a second transistor. The connection between the first transistor and the second transistor is base-to-base and emitter-to-emitter.

In U.S. Pat. No. 5,592,123 ("the '123 Patent") issued to Ulbrich on Jan. 7, 1997, discloses a floating current mirror circuit for achieving high open loop gain without additional voltage gain stages. According to Ulbrich's disclosure, this invention avoids additional frequency compensation and increased power dissipation. FIG. 1 illustrates the invention described in the '123 Patent featuring a current mirror bootstrap for increasing the output impedance of the current mirror by driving the common node 36 of the current mirror with emitter follower transistor 30. The current mirror differential input 39 is applied from a differential amplifier 37. By increasing the output impedance of a current mirror at the output of an amplifier stage, the open loop gain is increased thereby providing more closed loop accuracy as well as an improved power supply rejection ratio. The uncorrected bootstrap error is the difference in collector-emitter voltage between transistor 28 and transistor 26 that form the current mirror. This voltage is also the difference between node 34 and node 35 voltages which is proportional to 1/gm of transistor 30, where gm=[qIe/(KT)], and Ie=(current source 24)−(current source 21)−(current source 22). While clamping node 34 with the Vbe of transistor 30 provides beneficial increase in mirror output resistance, it limits the voltage swing available to drive an output stage that follows. The voltage swing Vsw=Vnode32−Vbe−V22−V24−V38, where Vnode32 is the positive supply voltage, Vbe is the base-emitter voltage of transistor 30, V22 is the voltage across current source 22, V24 is the voltage across current source 24, and V38 is the supply voltage common.

There is a need for a circuit that provides improved reference output circuit accuracy while accommodating both low output voltage and low supply voltage. There is also a need for a circuit that provides stable capacitive load drive capability at low supply quiescent current. There is also a need for a circuit that provides greater bootstrap output voltage swing without increasing the quiescent(unloaded) power dissipation of the circuit.

SUMMARY OF THE INVENTION

The present invention solves the needs addressed above. The present invention provides a circuit that includes a signal current mirror, a source follower output transistor, a sense transistor, and an output current mirror. This circuit has improved performance due to the source follower transistor, the sense transistor and the output current mirror, these items forming a common source difference amplifier. This common source difference amplifier adjusts the common voltage of the signal mirror to keep equal voltages at the input and output of the signal mirror. The voltage swing available at the output of the signal current mirror is increased over the prior art by Vbe−Vsat, where Vbe is the base-emitter voltage and Vsat is the minimum collector-emitter voltage of a bipolar transistor operating in the forward active mode. Thus, the common node of the mirror adapts to changing supply voltage, output load current and temperature so that the effect on output voltage is minimized. For optimum performance, the current density ratio of the output current mirror devices is equal to the current density ratio of the sense transistor to the source follower transistor.

The present invention uses a source follower output stage which is not used in the prior art. This source follower output stage provides advantages over the prior art, including lower output impedance to minimize output voltage change with changing load current as well as improved stability driving capacitive loads. Capacitive load drive capability is proportional to the source follower gate to common(ground) capacitance.

The prior art also does not include connecting two mirrors as in the present invention. The present invention uses an output mirror to bootstrap the signal mirror. This configuration provides increased voltage swing at the signal mirror output allowing a minimum output voltage Vbe−Vsat (or VT for MOSFETs) lower than the prior art. This may amount to a 400 mV output voltage reduction allowing for a 1.6V output voltage from a 1.8V (two battery) supply instead of 2.0V output voltage from a 2.7V (three battery) supply. An additional benefit is that the output mirror current is proportional to sinking load current for high efficiency. When the sinking load current is small, the output mirror current is low.

It is an object of the invention to provide improved circuit performance by boosting the output impedance of a current mirror so that changes in input supply voltage and load current have substantially less effect on output voltage.

It is also an object of the present invention to provide bootstrap accuracy at lower output and supply voltage without requiring a higher quiescent current.

It is further an object of the present invention to provide a circuit for use with varying output loads and capacitive loads.

The benefits of the present invention make the invention very useful in a number of applications. Those applications include battery-powered applications where as few batteries as possible are desired. Portable electronics, including CD players and cellular phones, would be benefited by aspects of the present invention.

BRIEF DESCRIPTION OF THE DRAWINGS

These and other objects, features, and characteristics of the present invention will become apparent to one skilled in the art from a close study of the following detailed description in conjunction with the accompanying drawings and appended claims, all of which form a part of this application. In the drawings:

DETAILED DESCRIPTION OF THE PRESENTLY PREFERRED EXEMPLARY EMBODIMENTS

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds, are therefore intended to be embraced by the appended claims.

Figure 1:
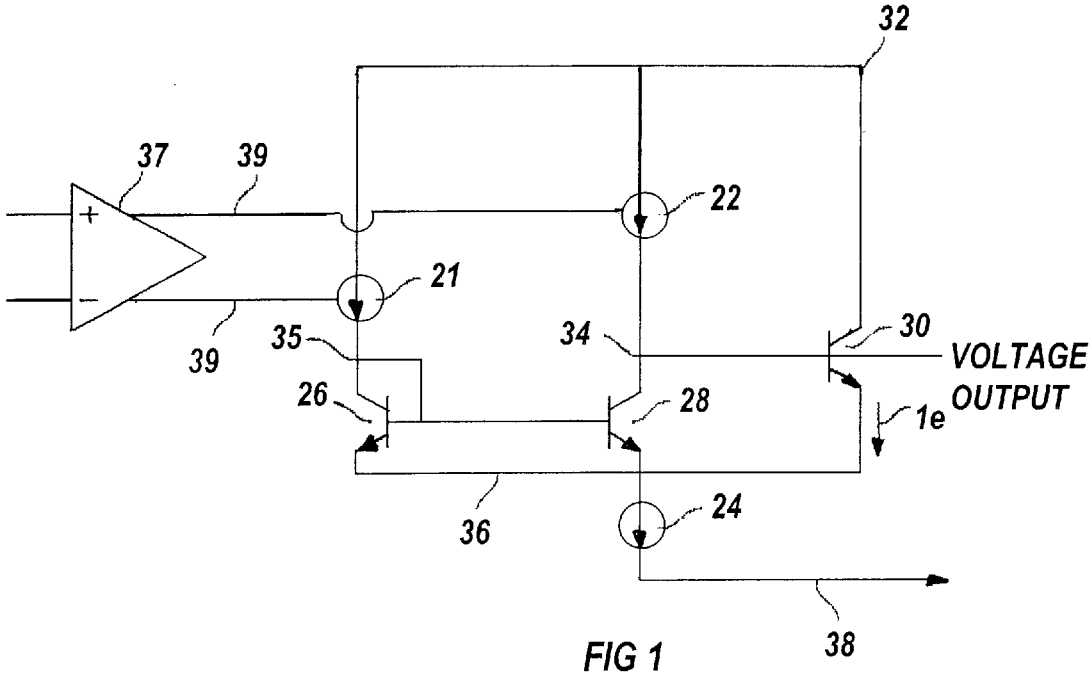
FIG 1 (Prior Art)
FIG. 1 is a schematic circuit diagram for a bootstrapped current mirror circuit in accordance with the prior art.
Figure 2:
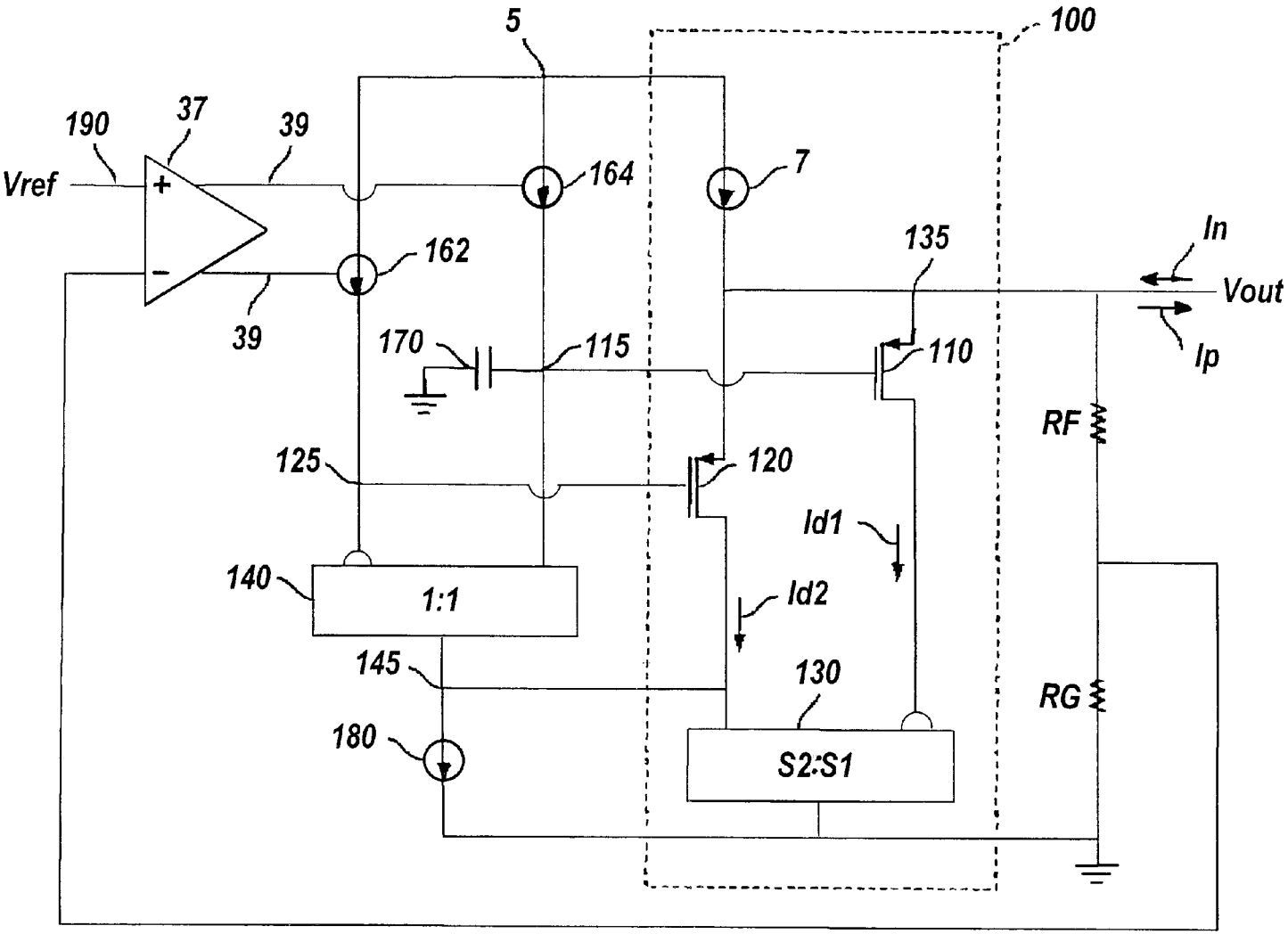
FIG. 2 is a schematic circuit diagram of a source follower output stage with adaptive current mirror bias in accordance with one embodiment of the present invention.

Disclosed is a circuit that is especially useful for applications for which the output voltage must be precise. Referring now to FIG. 2, illustrated is a source follower output stage with adaptive current mirror bias in accordance with one embodiment of the present invention. Configurations such as bandgap voltage reference circuits can act as inputs to this circuit with source follower output stage and adaptive current mirror bias shown in FIG. 2. Shown in FIG. 2 is an input reference voltage 190, an input supply voltage 5, and a source current 7. A common-source difference amplifier 100 is formed by source follower transistor 110, sense transistor 120, and an output mirror 130. A signal mirror 140 is also provided. Source follower transistor 110 and sense transistor 120 are input transistors with the same source current density. Sense transistor 120 provides input to the amplifier that allows for a balanced position. Output mirror 130 has input current Id1, and output voltage at node 145. Signal mirror 140 has input voltage at node 125 and output voltage at node 115.

The common source difference amplifier inputs are the input and output voltage of mirror 140. The voltage of node 125 at the input of mirror 140 is also the gate voltage of transistor 120, while the voltage at node 115 at the output of mirror 140 is also the gate voltage of transistor 110. A node 145 is common to the mirror 140, and is one output of common source difference amplifier 100, the other being the output voltage at node 135. The common source difference amplifier adjusts the common node 145 voltage of mirror 140 to keep the gate voltage of transistor 120 at reference node 125 equal to the gate voltage of transistor 110 at reference node 115. This adjustment is commonly known as "bootstrapping". This bootstrap effect boosts the output impedance of mirror 140 so that changes in supply voltage and load current have substantially less effect on the output voltage. This adjustment adapts the common node 145 of mirror 140 to changing supply voltage, output load current and temperature so that the effect on output voltage is minimized. The output voltage of the signal mirror at node 115 is clamped to the output node 135 by the Vgs of transistor 110 such that the voltage swing available at the output of the signal current mirror Vsw'=Vnode5−V164−V180−Vosm, where Vnode5 is the positive power supply voltage, V164 is the voltage across current source 164, V180 is the voltage across current source 180, and Vosm is the voltage across the signal current mirror output device. The additional voltage swing made available by this configuration over the prior art is Vsw−Vsw'=Vbe−Vosm.

The ratio of device channel width to length (W/L) in the mirror 130 is equal to the W/L ratio of the sense transistor 120 to source follower transistor 110 for optimum performance. The width to length ratio (W/L) of source follower transistor 110 may be equal to the width to length ratio (W/L) of sense transistor 120, thereby making the drain currents of those devices equal as represented by the formula: Id2=(S2/S1)*Id1, where S1 is the width to length ratio of the source follower transistor 110 and S2 is the width to length ratio of the sense transistor 120.

The current source 180 is provided equal to the sum of signal mirror currents 162, and 164 for optimum performance.

The uncorrected error of the common source difference amplifier is V(node115)−V(node125)=(gate voltage of transistor 110)−(gate voltage of transistor 120). This error is proportional to 1/gm of the source follower transistor and the sense transistor. The transconductance of the source follower transistor 110 can be shown as:

$$gm1=sqrt[2*Is1*\mu*Cox*S1]$$

where Id1 is the drain current of the source follower transistor 110, $\mu$ is the mobility of the holes in the induced P-channel, Cox is the gate capacitance, and S1 is the width to length ratio of source follower transistor 110.

Source follower transistor 110 has a gate, source and drain. The gate of source follower transistor 110 is coupled to node 115 which is the high impedance output voltage of the signal mirror. Node 115 is, in turn, operably coupled to compensation capacitor 170 for frequency stabilization. Capacitor 170 is also coupled to common(ground). Sense transistor 120 has a gate, source and drain. The gate of sense transistor 120 is coupled to node 125 which is the input voltage of the signal mirror.

This arrangement is more efficient than the emitter follower bootstrap and only requires one compensation capacitor 170 for additional frequency stability.

The output voltage Vout=[1+(Rf/Rg)]Vref since the input differential amplifier 37 drives the source follower output stage with its outputs 39 such that its inputs Vref and [Rg/(Rf+Rg)]Vout are equal. In this way, the output stage is controlled such that for sourcing load current Ip and sinking load current In, the gate voltage of transistor 110 (node 115) adjusts itself to accommodate whatever current Id1 is required to balance currents at node 135 so that Vout remains constant.

In addition, as sinking load current In increases, the bootstrap accuracy increases without requiring a higher quiescent current because the gm of transistor 110 increases. Also, the width to length ratio (W/L) of source follower transistor 110 may be greater than width to length ratio (W/L) of sense transistor 120 to improve current efficiency. For example, a low power reference may include an output stage with current Id2 less than one micro-amp while the sinking load current might be greater than one hundred micro-amps. Using this improved adaptive bias technology, the current load regulation is greatly improved.

Figure 3:
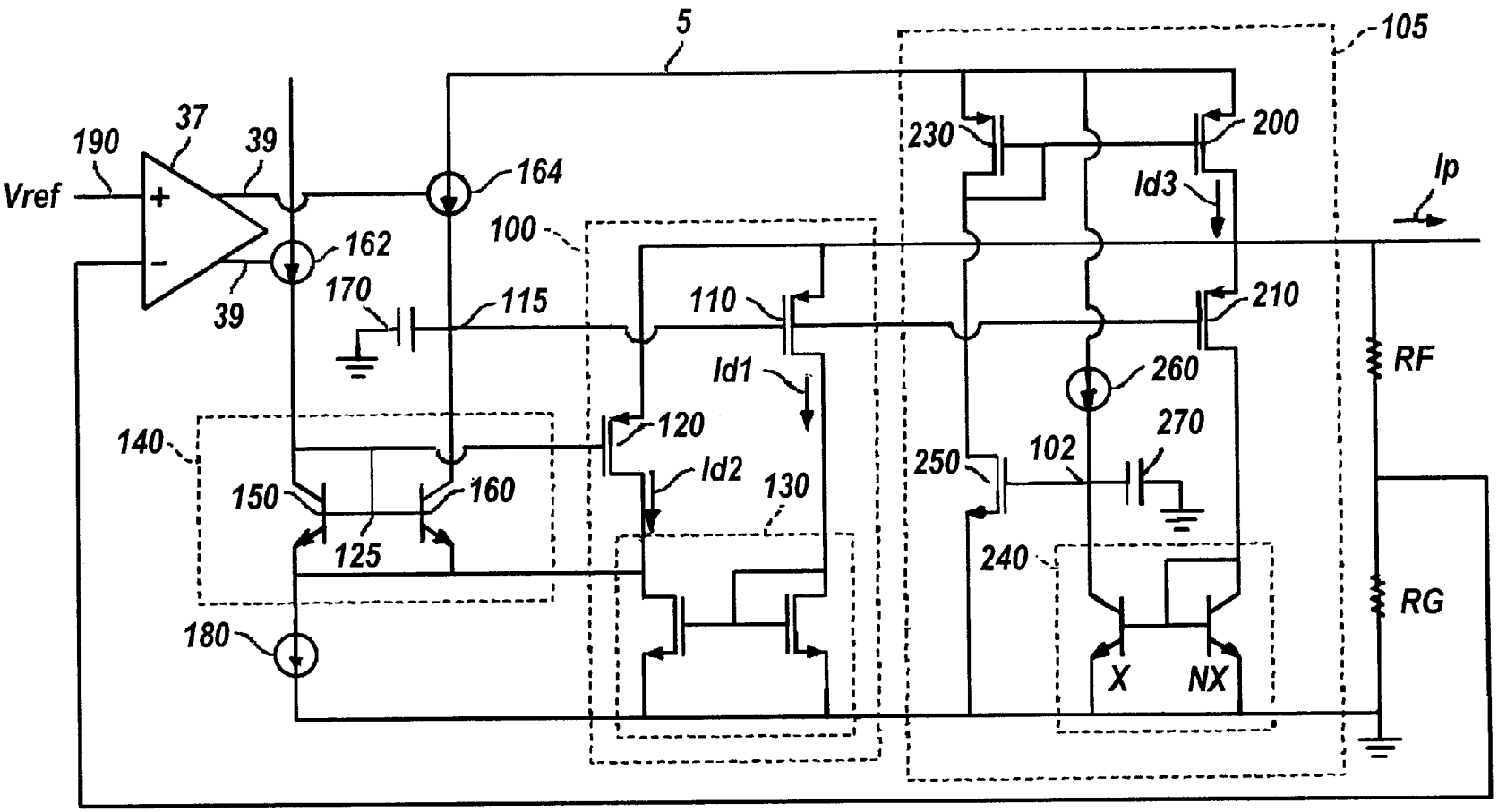
FIG. 3 is a schematic circuit diagram of a source follower output stage with adaptive current mirror bias including an NPN implementation of one current mirror, an NMOS implementation of the other current mirror and a regulated current source implementation of one current source in accordance with another embodiment of the present invention.

Referring now to FIG. 3, illustrated is a schematic circuit diagram of a source follower output stage with adaptive current mirror bias including an NPN implementation of the signal current mirror 140, an NMOS implementation of the output current mirror 130, and with a regulated current source 105 in accordance with another embodiment of the present invention. Signal current mirror 140 is a floating mirror circuit, meaning the emitters are coupled not to a ground but to a node at a different potential or to a node coupled to the ground by a current source. Mirror 140 is composed of a first NPN transistor 150 and a second NPN transistor 160. Transistors 150, 160 include a base, emitter and collector region. The base of transistor 150 is coupled to the base of transistor 160, and the emitter of transistor 150 is coupled to the emitter of transistor 160. Since the bases and emitters are coupled together, the transistors have the same base-to-emitter voltages. Transistor 150 is also connected as a diode by shorting its collector to its base. The input current 162 flows through the diode connected transistor and thus establishes a voltage across transistor 150 that corresponds to the value of the current 162. As long as transistor 160 is maintained in the active region, its collector current 164 will be approximately equal to current 162.

This mirror circuit uses all NPN transistors to overcome undesirable limited frequency responses of similar circuits employing PNP transistors.

Like the circuit illustrated in FIG. 2, the uncorrected error of the common source difference amplifier is V(node 115)−V(node 125)=(gate voltage of transistor 110)−(gate voltage of transistor 120). This error is proportional to 1/gm of the source follower transistor and the sense transistor. The transconductance of the source follower transistor 110 can be shown as:

$$g.sub.m1=sqrt[2*Id1*\mu*Cox*S1]$$

where Id1 is the drain current of the source follower transistor 110, $\mu$ is the mobility of the holes, Cox is the gate capacitance, and S1 is the width to length ratio of source follower transistor 110.

The regulated current source 105 includes a first PMOS transistor 200 and a second PMOS transistor 230. The gate of said first PMOS transistor is operably coupled to the gate of the second PMOS transistor. The source of a third PMOS transistor 210 is operably coupled to the drain of first PMOS transistor 200 and the output Vout. The gate of the third PMOS transistor 210 is coupled to the gate of source follower transistor 110. The regulated current source also includes a current mirror circuit 240; the current mirror circuit is operably coupled to the drain of third PMOS transistor 210. A node 102 is common to the gate of an NMOS transistor 250, a bias current 260, a second compensation capacitor 270, and the output of mirror 240. The drain of NMOS transistor 250 is operably coupled to the gate and drain of second PMOS transistor 230. The compensation capacitor is also coupled to ground. The function of the regulated current source 105 is to compensate for increasing sourcing load current Ip by increasing drain current Id3 of transistor 200. This is accomplished by summing the currents at node 102, adjusting the gate voltage of transistor 250 and 200 so that the drain current in transistor 210 is equal to N times the current source 260 regardless of the sourcing load current Ip. In this way, the gate voltage of transistor 210 (node 115) does not have to change and upset the balance of the common source difference amplifier 100.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A source follower output stage circuit with adaptive current mirror bias, comprising:

a common source difference amplifier device including a source follower transistor device, an output mirror circuit device, a sense transistor device, and a first current source device, wherein said source follower transistor device has a first voltage that is measured at a first voltage node and said sense transistor device has a second voltage that is measured at a second voltage node;

a second mirror circuit device, wherein the second voltage is input into the second mirror circuit device and the first voltage is output from the second mirror circuit device;

a first node common to the second mirror circuit device, the sense transistor device, and an output of the output mirror circuit device, wherein said first node has a common voltage;

an input device for inputting two input currents, wherein one of said input currents is input at said first voltage node, and the second input current is input at said second voltage node;

a second current source device at said first node;

such that the common source difference amplifier device adjusts said common voltage such that the first voltage of the source follower transistor device is equal to the second voltage of the sense transistor device and the effect on a source follower output voltage is minimized with variations in supply voltage, temperature and output load current.

2. The circuit of claim 1 wherein the width to length ratio of the sense transistor device is equal to the width to length ratio of the source follower transistor device, such that the drain currents of said sense transistor device and said source follower transistor device are equal to each other.

3. The circuit of claim 1 wherein the width to length ratio of the source follower transistor device is proportional to the width to length ratio of the sense transistor device, such that the drain currents of said sense transistor device and said source follower transistor device are proportional to each other.

4. The circuit of claim 1 wherein the output mirror circuit device includes NMOS transistors.

5. The circuit of claim 1 wherein the output mirror circuit device includes two NMOS transistors and the gates of said two NMOS transistors are coupled together and the sources of said two NMOS transistors are coupled together, and the drain of one of said NMOS transistors is connected to the gates of said two NMOS transistors while the drain of the other NMOS transistor is the mirror output.

6. The circuit of claim 1 wherein the second mirror circuit device is an NPN current mirror circuit.

7. The circuit of claim 6 wherein the NPN current mirror circuit includes two NPN transistors, wherein the base of the first NPN transistor is coupled to the base of the second NPN transistor, and the collector of the second of said NPN transistors is connected to the bases of said two NPN transistors.

8. The circuit of claim 1 wherein the width to length ratio of the source follower transistor device is greater than the width to length ratio of the sense transistor device.

9. The circuit of claim 1 further comprising:

a first compensation capacitor device for providing frequency stability, wherein said first compensation capacitor device is coupled to the first voltage node and also to ground.

10. The circuit of claim 1 wherein said first current source device is regulated such that the current of the common source difference amplifier device is minimized and independent of current provided to a load at an output of the source follower transistor device.

11. The circuit of claim 9 wherein the first current source device is a regulated current source device.

12. The circuit of claim 11 wherein the regulated current source device includes a first PMOS transistor device, wherein said first PMOS transistor device is configured with its drain coupled to its gate;

a second PMOS transistor device, wherein the gate of said first PMOS transistor device is operably coupled to the gate of the second PMOS transistor device;

a third PMOS transistor device operably coupled to the second PMOS transistor device, said third PMOS transistor device having its gate coupled to the gate of said source follower transistor device;

a current mirror circuit, wherein said current mirror circuit is operably coupled to the third PMOS transistor device;

a current source node, said current source node being common to an NMOS transistor device, a source current and a second compensation capacitor; wherein said NMOS transistor device is operably coupled to the first PMOS transistor device; and wherein said second compensation capacitor is coupled to ground.

13. The circuit of claim 9 further comprising:

a feedback circuit device for controlling the two input currents.

14. A source follower output stage circuit with adaptive current mirror bias, comprising:

a source follower transistor, an output mirror circuit, a sense transistor, and a first current source, wherein said source follower transistor has a first voltage that is measured at a first voltage node and said sense transistor has a second voltage that is measured at a second voltage node;

a second mirror circuit, wherein the second voltage is input into the second mirror circuit and the first voltage is output from the second mirror circuit;

a first node common to the second mirror circuit, the sense transistor, and an output of the output mirror circuit, wherein said first node has a common voltage;

a circuit for inputting two input currents, wherein one of said input currents is input at said first voltage node, and the second input current is input at said second voltage node;

a second current source at said first node;

such that the first voltage of the source follower transistor is equal to the second voltage of the sense transistor and the effect on a source follower output voltage is minimized with variations in supply voltage, temperature and output load current.

15. The circuit of claim 14 wherein the width to length ratio of the sense transistor is equal to the width to length ratio of the source follower transistor, such that the drain currents of said sense transistor and said source follower transistor are equal to each other.

16. The circuit of claim 14 wherein the width to length ratio of the source follower transistor is proportional to the width to length ratio of the sense transistor, such that the drain currents of said sense transistor and said source follower transistor are proportional to each other.

17. The circuit of claim 14 wherein the output mirror circuit includes NMOS transistors.

18. The circuit of claim 17 wherein the output mirror circuit includes two NMOS transistors and the gates of said two NMOS transistors are coupled together, and the sources of said NMOS transistors are coupled together, and the drain of one of said NMOS transistor is connected to the gates of said two NMOS transistors, while the drain of the other NMOS transistor is the mirror output.

19. The circuit of claim 14 wherein the second mirror circuit is an NPN current mirror circuit.

20. The circuit of claim 19 wherein the NPN current mirror circuit includes two NPN transistors, wherein the base of a first NPN transistor is coupled to the base of a second NPN transistor, and the collector of the second NPN transistor is connected to the bases of said first and second NPN transistors.

21. The circuit of claim 14 wherein the width to length ratio of the source follower transistor is greater than the width to length ratio of the sense transistor.

22. The circuit of claim 14 further comprising:

a first compensation capacitor for providing frequency stability, wherein said first compensation capacitor is coupled to the first voltage node and also to ground.

23. The circuit of claim 14 wherein said first current source is regulated such that the current of a common source difference amplifier is minimized and independent of current provided to a load at a source follower output.

24. The circuit of claim 22 wherein the first current source is a regulated current source.

25. The circuit of claim 24 wherein the regulated current source includes a first PMOS transistor, wherein said first PMOS transistor is configured with its drain coupled to its gate;

a second PMOS transistor, wherein the gate of said first PMOS transistor is operably coupled to the gate of the second PMOS transistor;

a third PMOS transistor operably coupled to the second PMOS transistor, said third PMOS transistor having its gate coupled to the gate of said source follower transistor;

a current mirror circuit, wherein said current mirror circuit is operably coupled to the third PMOS transistor;

a current source node, said current source node being common to an NMOS transistor, a source current and a second compensation capacitor; wherein said NMOS transistor is operably coupled to the first PMOS transistor; and wherein said second compensation capacitor is coupled to ground.

26. The circuit of claim 14, further comprising:

a feedback circuit for controlling the two input currents.

* * * * *